United States Patent [19]

Brown

[11] Patent Number: 5,016,284

[45] Date of Patent: May 21, 1991

[54] LOCKABLE CLOTHING

[76] Inventor: Jack E. Brown, 2402 Stockton Pl., Marietta, Ga. 30066

[21] Appl. No.: 534,939

[22] Filed: Jun. 8, 1990

[51] Int. Cl.[5] ..... A41D 1/02; A41D 1/06; E05B 69/00

[52] U.S. Cl. ..... 2/69; 2/108; 2/85; 2/93; 2/65; 2/79; 2/227; 70/59

[58] Field of Search ..... 70/59; 2/69, 65, 79, 2/85, 93, 108, 227

[56] References Cited

U.S. PATENT DOCUMENTS

| | | | |
|---|---|---|---|
| 972,535 | 10/1910 | Hoover | 70/59 |
| 1,346,320 | 7/1920 | Law | 2/89 |
| 3,074,074 | 1/1963 | Lovering | 224/184 |
| 3,562,812 | 2/1971 | Greggains | 2/94 |
| 4,683,730 | 8/1987 | Lee | 70/59 |
| 4,706,858 | 11/1987 | Whatley | 224/184 |
| 4,731,882 | 3/1988 | Ekman | 2/69 |
| 4,813,080 | 3/1989 | Toso | 2/94 |
| 4,823,569 | 4/1989 | Leinoff et al. | 70/59 |

FOREIGN PATENT DOCUMENTS

| | | | |
|---|---|---|---|
| 57380 | 8/1912 | Austria | 70/59 |
| 2738530 | 3/1979 | Fed. Rep. of Germany . | |

*Primary Examiner*—Werner H. Schroeder
*Assistant Examiner*—Gloria Hale
*Attorney, Agent, or Firm*—Jones, Askew & Lunsford

[57] ABSTRACT

The present invention relates to an improved locking arrangement for clothing. In one aspect of the invention, a garment includes an eyelet operatively associated with a major portion of the garment. An elongated locking device, such as a lockable cable, is passed through the eyelet to secure the garment to a stationary object. In a second embodiment of the invention, a garment includes a length of cable attached to a major portion of the garment along a substantial length of the cable. The cable has a free end operatively associated with a device for locking the cable to a stationary object to secure the garment against theft.

11 Claims, 2 Drawing Sheets

LOCKABLE CLOTHING

TECHNICAL FIELD

The present invention relates generally to wearing apparel, and relates more specifically to apparel, such as exercise clothing and the like, which can be locked to a stationary object to secure the clothing against theft.

BACKGROUND OF THE INVENTION

Runners and other exercisers often encounter a problem when they wear a warm-up suit during the initial phases of exercise, in that once the wearer begins to exert himself or the ambient temperature warms up, the warm-up suit is no longer needed. The exerciser is now faced with the problem of what to do with the warm-up suit while he continues his workout, since many exercise areas, especially running tracks, lack proper facilities for locking up personal belongings. Yet leaving the warm-up suit unattended and unsecured is an invitation to theft. This problem is especially aggravating in the case of a runner, for example, whose continued exercise will take him to geographically remote locations. Since sportswear and exercise apparel can sometimes cost several hundreds of dollars, there is a need to provide a means for safely and temporarily storing the exercise apparel at a workout site when it is not needed.

Department stores and the like have long used cable locking devices to secure expensive clothing to their respective fixtures. These devices are typically passed through a sleeve or other area of the garment and locked to a rack. While such arrangements are satisfactory in retail surroundings where store clerks are present, these prior art locking devices do not provide total security in an unattended environment. Given sufficient time, a would-be thief could rip the seam of the garment, remove the garment from the fixture, and make off with a serviceable garment.

Thus, there is a need for an improved arrangement for locking a garment to a stationary object to secure the garment against theft.

There is a further need for a garment which can be secured to a stationary object so completely that removal of the garment from the stationary fixture would necessitate its virtual destruction, thereby rendering the garment unserviceable and removing the incentive for theft.

There is yet another need for a locking arrangement for securing a garment to a fixture such that the garment cannot be removed from the locking device by simply slitting the seams of the garment.

There is still another need for an improved arrangement for locking a garment to a stationary object which does not require extraneous locking devices.

SUMMARY OF THE INVENTION

As will be seen, the present advantage overcomes these and other disadvantages associated with prior art garment locking arrangements. Stated generally, the present invention comprises an improved arrangement for locking a garment, such as a warm-up suit or the like, to a stationary object to secure the garment against theft. The arrangement fastens the garment to a fixture so securely that unauthorized removal of the garment from the fixture would require the virtual destruction of the garment, thereby rendering the garment unserviceable and removing the incentive for theft. The arrangement of the present invention secures the locking device in such a way that the garment cannot be removed from the locking device by merely slitting the seams of the garment. In one aspect, the present invention comprises a locking arrangement which is integral with the garment so as not to require a separate locking device.

Stated somewhat more specifically, a first embodiment of the present invention comprises a garment having an eyelet operatively associated with a major portion of the garment. An elongated locking device is passed through the eyelet and secured to a stationary object. In the disclosed embodiment, the eyelet is located in a major portion of the garment removed from the seams, such that the garment cannot be removed from the locking device by slitting the seams.

A second aspect of the present invention comprises a garment and a length of cable attached to a major portion of the garment along a substantial portion of the length of cable. In the disclosed embodiment, the cable is fastened into the seams of the garment. Two free ends of the cable are normally disposed within a pocket, for example. The free cable ends are locked to a stationary object to secure the garment against theft.

Thus, it is an object of the present invention to provide an improved arrangement for locking a garment to secure the garment against theft.

It is a further object of the present invention to provide a garment which can be secured to a stationary object so completely that removal of the garment from the stationary object would necessitate its virtual destruction, thereby rendering the garment unserviceable and removing the incentive for theft.

It is yet a further object of the present invention to provide a locking arrangement for securing a garment to a fixture wherein the locking device is secured in such a manner that the garment cannot be removed from the locking device by slitting the seams of the garment.

It is still another object of the present invention to provide an improved arrangement for locking a garment to a stationary object which is fully self-contained and does not require extraneous locking devices.

Other objects, features, and advantages of the present invention will become apparent upon reading the following specifications, when taken in conjunction with the drawings and the appended claims.

DETAILED DESCRIPTION OF THE INVENTION

Figure 1:
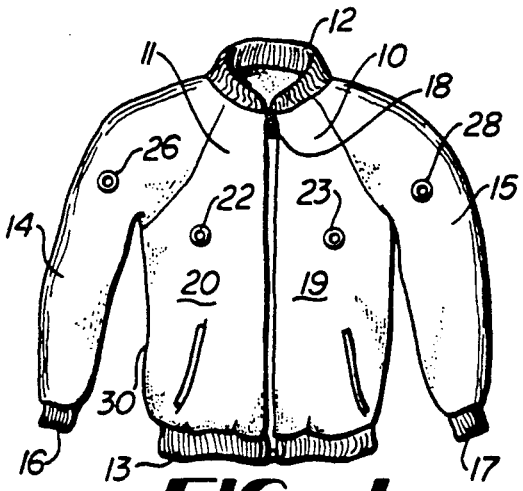
FIG. 1 is a front view of an upper body garment having eyelets according to the present invention.
Figure 2:
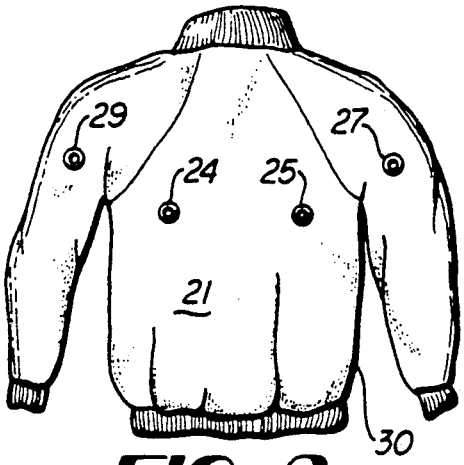
FIG. 2 is a rear view of the upper body garment of FIG. 1.

Referring now to the drawings, in which like numerals indicate like elements throughout the several views, FIG. 1 discloses an upper body garment 10 according to the present invention. The upper body garment 10 comprises a main body 11, a collar 12, a waistband 13, sleeves 14 and 15 extending from the garment body, and cuffs 16 and 17. A zipper 18 runs down the front center of the garment 10 and divides the front portion of the garment into left and right panels 19 and 20, respectively. The rear portion of the garment main body 11 is comprised of a single panel 21, as shown in FIG. 2.

Eight eyelets 22–29 are located on the upper body garment 10. The eyelet 22 is located in the front right panel 20 of the garment and the eyelet 23 is located on the corresponding front left panel 19. The eyelets 24 and 25 are located in the center area of the rear panel 21; the eyelet 24 is located on the left side of the rear panel and the eyelet 25 on the right side. There are two eyelets on each sleeve 14, 15. The right sleeve 14 has the eyelet 26 located on the front portion and the eyelet 27 on the rear portion. The eyelets 28 and 29 on the left sleeve 15 are located similarly.

The eyelets are preferably made of a flexible, high strength plastic material that will not irritate the skin. The eyelets may optionally be covered with a flap of material when not in use.

Figure 4:
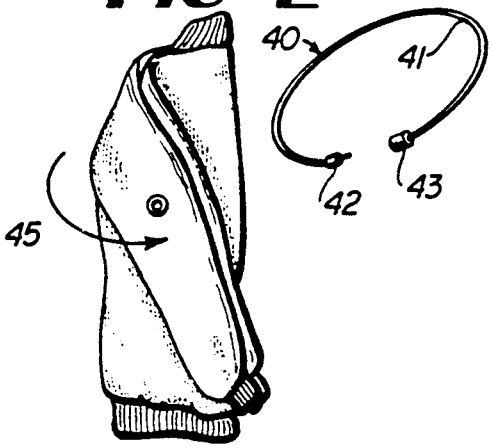
FIG. 4 is a front view of the upper body garment of FIG. 3 folded a second time.

A cable locking device 40 is shown in FIG. 4. The device 40 is made up of a length of cable 41 and locking ends 42 and 43. The cable 41 and at least one of the locking ends 42, 43 are dimensioned to be received through the eyelets 22–29. The cable described in the present invention may be comprised of plastic, metal, or any other material having the requisite strength and toughness properties that would make it difficult to cut. The plastic exterior of the cable helps the cable to run smoothly along the garment fabric and also helps prevent the cable from rusting.

Figure 3:
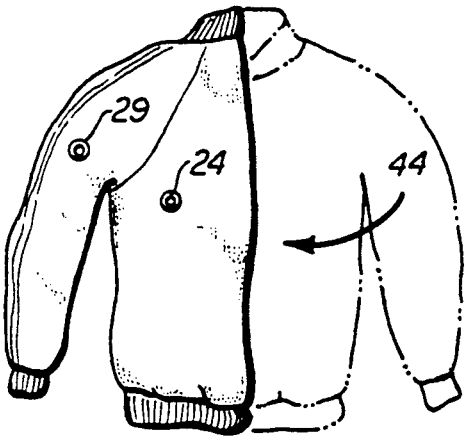
FIG. 3 is a front view of the upper body garment of FIG. 1 being folded a first time.

To lock the upper body garment 10, the garment is placed flat with the front panels 19 and 20 lying on top the rear panel 21 as shown in FIG. 1. In this position all front eyelets 22, 23, 26, and 28 align with all the rear eyelets 24, 25, 27, and 29. Next, the garment is folded in half so as to superimpose the left sleeve 15 onto the right sleeve 14 as depicted by the arrow 44 shown in FIG. 3. Again the eyelets on the right half of the garment align with those on the left. The garment is then folded a second time along an axis located halfway between the sleeve eyelets and the eyelets located on the main body 11 of the garment 10, as shown by the arrow 45 in FIG. 4.

Figure 5:
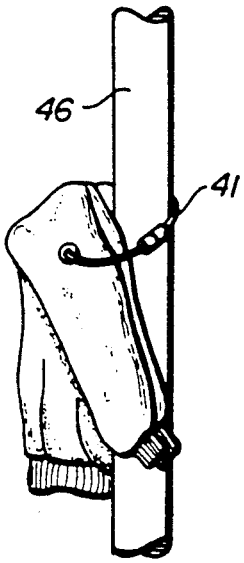
FIG. 5 is a front view of the garment of FIG. 1 folded and locked to a fixed object.

With the garment completely folded and all of the eyelets thus aligned, one end 42 of the cable 41 is passed through all of the eyelets. The cable 41 is then passed around a fixed object 46 as shown in FIG. 5. The garment 10 is secured to the fixed object 46 by locking the cable ends 42 and 43 together.

While the use of the garment 10 has been described with respect to a cable 41 which is passed through the various eyelets, it will be appreciated that other elongated locking devices such as chain and lock, or a padlock within elongated hasp may be used in lieu of the cable 41.

In the first embodiment of the present invention, each eyelet 22–29 is attached to the garment 10 at a location removed from any fabric edges or seams. In addition each eyelet 22–29 is located at a position on the garment so that all eyelets will align when the garment 10 is folded. For example, the right front eyelet 22 is located a distance halfway between the right side edge 30 and the zipper 18. The left front eyelet 23 is similarly positioned. Moreover, the eyelets 24–25 located on the rear panel are located one-quarter of the width of the garment 10 in from the respective side edges. The eyelets located on the sleeves are positioned an equal distance from the eyelets on the main body 11 of the garment 10. In this manner, when the garment has been folded in the manner hereinbefore described, all of the eyelets will be aligned, thereby facilitating the passing of the cable through the various eyelets.

Figure 6:
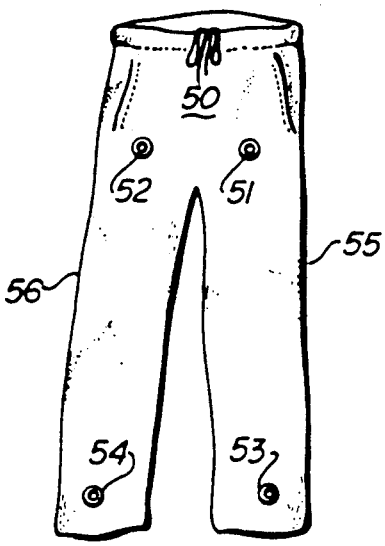
FIG. 6 is a front view of a lower body garment according to the present invention.

Turning now to FIG. 6, the lower body garment 50 has eyelets located in the hip and ankle areas. Furthermore, the upper front left and right hip eyelets 51 and 52, respectively, are positioned one-fourth of the width from the left and right side seams 55 and 56, respectively.

The lower body garment 50 is folded and locked in the same manner as described above for the upper body garment 10. First, the lower body garment 50 is placed flat so that the front eyelets 51–54 align with the eyelets located on the rear portion of the lower body garment (not shown). The lower body garment 50 is then folded in half along a vertical line, which causes the left eyelets to align with the right eyelets. Finally, the lower body garment is folded in half again along a horizontal line, joining the eyelets located in the hip area with those located in the lower leg area. With all of the eyelets thus aligned, the lower body garment 50 is ready to be locked in the same manner as that previously discussed for the upper body garment 10.

While the present invention has been disclosed with respect to garments having a plurality of eyelets which align when the garment is folded in a particular manner, it will be understood that a greater or lesser number of eyelets may be used, and that eyelets may be located so as to align when the garment is folded in a manner different from the manner described hereinabove.

Figure 7:
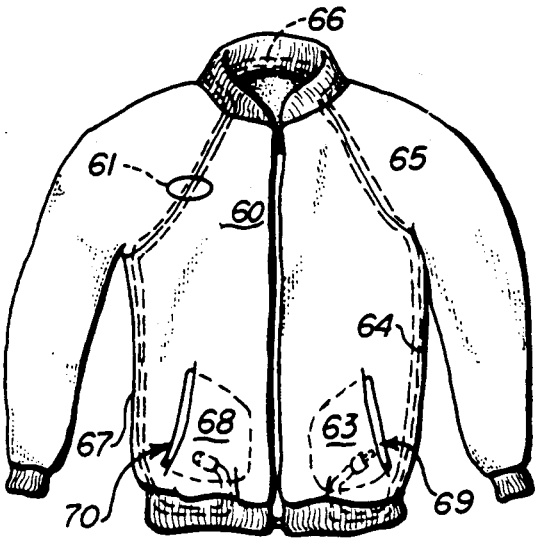
FIG. 7 is a front view of an upper body garment according to a second embodiment of the present invention.

Turning now to a second embodiment of the present invention, FIG. 7 shows an upper body garment 60 having a length of cable 61 sewn onto the inner face of the garment. Within the upper body garment 60, the cable 61 begins at a first pocket 63 and travels along one side 64 of the garment up to the shoulder 65 and neck 66 areas of the garment, around to the other side 67 of the garment and back down into the opposite pocket 68. A substantial length of the cable 61 is sewn on the garment 60 and attached along its length. The length of cable 61 has lockable mating elements 69 and 70 secured to its ends. The lockable mating elements 69 and 70 are normally located in opposite pockets 63 and 68, respectively.

Figure 8:
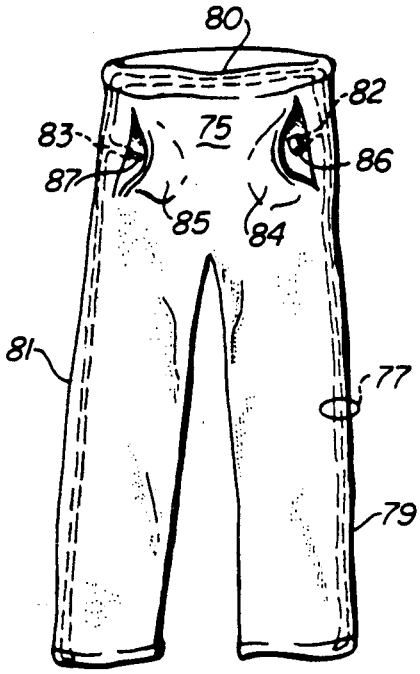
FIG. 8 is a front view of a lower body garment according to a second embodiment of the present invention.
Figure 9:
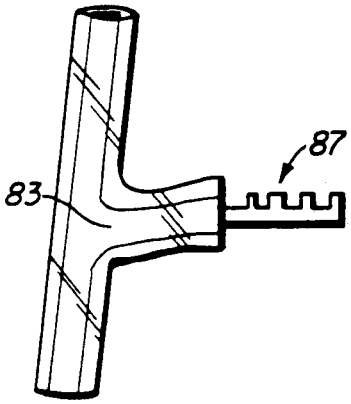
FIG. 9 is a detailed view of a first end of a cable locking device which forms a part of the garment of FIG. 8.
Figure 10:
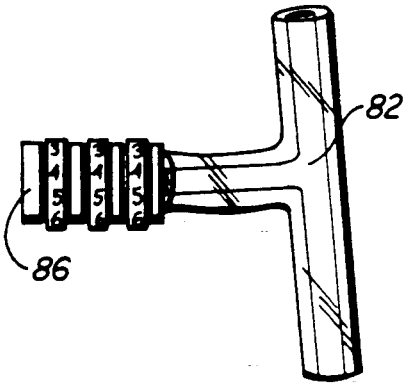
FIG. 10 is a detailed view of a second end of the cable locking device of FIG. 9.

FIG. 8 shows a pair of trousers or other similar lower body garment 75 having a length of cable 77 sewn into the lining of the garment. The cable 77 is sewn along the seam 79 of the outer part of a first leg, up across the hip area 80 and down the seam 81 of a second leg. To incorporate a locking mechanism at intermediate points along the length of the cable 77, junctions 82 and 83 are provided near a first and second pocket 84 and 85 respectively. Lockable elements 86 and 87 are attached to junctions 82 and 83 normally located in the first and second pockets 84 and 85, respectively. The assembly of the cable 77, junctions 82 and 83, and lockable mating elements 86 and 87 is shown in more detail in FIGS. 9 and 10.

The garments 60, 75 are secured to a stationary object by extracting the free ends of the cables 61, 77 from their normal storage positions inside their respective pockets. The free ends are then passed around a stationary object and locked together to secure the garments against theft.

The cables 61, 77 are preferably made of a flexible material so that it can be easily sewn into the garment and easily move with the garment. Moreover, it is preferable that the cables be flexible so that they cannot be easily ripped away or cut from the garment. The cables 61, 77 are also preferably flat in cross section so as to eliminate unsightly bulges in the lines of the garment and not cause discomfort to the wearer. The cables 61, 77 of the disclosed embodiment are comprised of high strength plastic or a metal coated with plastic. The plastic inhibits rust formation and splintering of the metal cable which may cause damage to the surrounding fabric.

The cables 61, 77 must be properly secured to the garment. This can be accomplished by providing a strip of plastic extending laterally from the cable. The strip of plastic would be sewn into the seam of the garment. Alternatively, a flat cable having apertures along the length of the cable may also be used. Apertures may be provided along the length of the cable 61 or 77 through which a needle may pass to stitch the cable into the seam of the garment.

The length of cable required for the second embodiment of the invention may vary with the size and design of the garment. The upper body garment 60 of FIG. 7 would require approximately 70 inches of continuous cable for a men's large size. The lower body garment 75 of FIG. 8 would approximately require approximately nine feet of continuous cable for a men's extra-large size.

The lengths of cable 61, 77 described in garments 60 and 75 may be comprised of one cable having two free ends or two separate cables, one end of each cable being lockable to a corresponding end of the other cable. In addition, while the length of cable described in both aspects of the present invention has lockable mating elements attached to the free ends of the cable, it is anticipated that equally effective results may be obtained if eyelets were attached to the free ends of the cables and a separate locking device were passed through the eyelets and locked to secure the cable ends together.

Finally, it will be understood that the foregoing embodiments of lockable clothing have been disclosed by way of example, and that other modifications may occur to those skilled in the art without departing form the scope of the appended claims.

I claim:

1. An article of manufacture comprising:

a garment;

a length of cable being attached to a major portion of the garment along a substantial portion of said length of cable, the cable having a free end; and means operatively associated with said free end for locking said cable to a stationary object; whereby said garment is secured against theft by locking said operatively associated means to said stationary object.

2. The article of claim 1 where said cable is metal.

3. The article of claim 1 wherein said operatively associated means comprises a second free end and a means for locking the second free end to said first free end.

4. The article of claim 3 wherein said second free end comprises a length of cable.

5. The article of claim 3 wherein the second free end comprises a second free end of said cable.

6. An article of clothing comprising:

a garment;

a plurality of eyelets operatively associated with said garment and disposed such that said plurality of eyelets can be aligned by folding said garment in a predetermined manner; and an elongated locking device configured to be passed through said aligned plurality of eyelets when said garment is folded in said predetermined manner, whereby said elongated locking device can be passed through said aligned plurality of eyelets and anchored to a fixed object to secure said garment against theft.

7. The article of clothing of claim 6, wherein said plurality of eyelets comprise a plurality of reinforced openings formed in said garment.

8. The article of clothing of claim 6, wherein said elongated locking device comprises a length of cable.

9. An article of clothing comprising:

a plurality of fabric sections joined to form a garment having seams and free edges;

an eyelet operatively associated with said garment and disposed at a location remote from said seams and free edges of said garment; and an elongated locking device configured to be passed through said eyelet and secured to a stationary object, whereby removal of said garment without unlocking said locking device would render said garment unserviceable.

10. The article of claim 9, wherein said eyelet comprises a reinforced opening formed in one of said fabric sections.

11. The article of claim 9, wherein said elongated locking device comprises a length of cable.

* * * * *